United States Patent [19]

Jerabek

[11] Patent Number: 4,636,818

[45] Date of Patent: Jan. 13, 1987

[54] CARBONLESS SYSTEM INCLUDING SOLVENT-ONLY MICROCAPSULES

[75] Inventor: Richard J. Jerabek, Grand Island, N.Y.

[73] Assignee: Moore Business Forms, Inc., Grand Island, N.Y.

[21] Appl. No.: 742,113

[22] Filed: Jun. 5, 1985

[51] Int. Cl.[4] ..... B41M 5/16; B41M 5/22

[52] U.S. Cl. ..... 346/213; 346/206; 346/215; 427/150; 427/151

[58] Field of Search ..... 346/204, 213, 215, 206, 346/226; 427/150, 151

[56] References Cited

U.S. PATENT DOCUMENTS

| | | |
|---|---|---|
| Re. 30,041 | 7/1979 | Maalouf . |
| Re. 30,116 | 10/1979 | Maalouf . |
| 2,299,694 | 10/1942 | Green . |
| 2,712,507 | 7/1955 | Green . |
| 3,016,308 | 1/1962 | Macaulay . |
| 3,429,827 | 2/1969 | Ruus . |
| 3,663,256 | 5/1972 | Miller et al. . |
| 3,672,935 | 6/1972 | Miller et al. . |
| 3,720,534 | 3/1973 | Macaulay et al. . |
| 4,003,589 | 1/1977 | Konishi et al. . |
| 4,071,469 | 1/1978 | Vincent et al. . |
| 4,096,314 | 6/1978 | Cespon . |
| 4,130,299 | 12/1978 | Wygant . |
| 4,147,830 | 4/1979 | Kato et al. . |
| 4,187,233 | 2/1980 | Petitpierre . |
| 4,211,436 | 7/1980 | Kuhlthau et al. . |
| 4,250,098 | 2/1981 | Chang . |
| 4,287,074 | 9/1981 | Earhart et al. . |
| 4,295,662 | 10/1981 | Tutty . |
| 4,309,047 | 1/1982 | Petitpierre . |
| 4,316,036 | 2/1982 | Petitpierre . |
| 4,335,013 | 6/1982 | Allart et al. ..... 346/213 |
| 4,343,939 | 8/1982 | Cesark et al. . |
| 4,343,944 | 8/1982 | Burri . |
| 4,355,823 | 10/1982 | Burri . |
| 4,363,503 | 12/1982 | Schmidt et al. . |
| 4,372,581 | 2/1983 | Schumacher et al. . |
| 4,398,753 | 8/1983 | Asano et al. . |

FOREIGN PATENT DOCUMENTS

| | | |
|---|---|---|
| 1290369 | 9/1972 | United Kingdom . |
| 1417206 | 12/1975 | United Kingdom . |

OTHER PUBLICATIONS

Jablonski et al., "Solvent-Assisted Pressure-Effected Image Transfer", IBM Tech. Discl. Bul., vol. 14, #10, 3-1972.

*Primary Examiner*—Bruce H. Hess

*Attorney, Agent, or Firm*—Allegretti, Newitt, Witcoff & McAndrews, Ltd.

[57] ABSTRACT

A carbonless system having improved imaging characteristics by the use of microcapsules containing only solvent is disclosed. The solvent-only capsules are disposed within a carbonless system to enhance the resulting image without the use of additional dye precursor.

6 Claims, No Drawings

CARBONLESS SYSTEM INCLUDING SOLVENT-ONLY MICROCAPSULES

BACKGROUND OF THE INVENTION

1. Field of the Invention

The present invention relates to carbonless copying systems.

2. Description of the Prior Art

Carbonless copying systems usually include a plurality of paper sheets or substrates arranged in a manifold set, each sheet of the set having one or more coatings on its surfaces. The manifold set is designed so that when a marking pressure caused by a typewriter, pen, or other instrument is applied to the outermost sheet, a colored mark will be formed on at least one surface of each sheet of the manifold set.

To this end, the top sheet of the manifold set to which the marking pressure is applied with a coating on its back surface. This coated back surface includes microcapsules containing an initially colorless chemically reactive color-forming dye precursor as the fill material. The upper surface of the next sheet, which is adjacent to the back surface of the top sheet, is coated with a material containing a component, such as phenolic resin or reactive clay, that is capable of reacting with the colorless dye precursor contained in the microcapsules to produce a color. Thus, a marking pressure on the upper surface of the top sheet will rupture the microcapsules on the bottom surface and release the colorless dye precursor. The colorless dye precursor then chemically reacts with the reactive component of the coated front of the lower sheet to produce a colored mark corresponding to the area of marking pressure. In similar fashion, colored marks are produced on each succeeding sheet of the manifold set by the marking pressure rupturing the microcapsules carried on the lower surfaces of each sheet.

The sheets of the manifold set in carbonless copying systems are designated in the art by the terms CB, CFB, and CF, which stand respectively for "coated back", "coated front and back", and "coated front". The CB or transfer sheet is usually the top sheet of the manifold set and the sheet upon which the marking pressure is applied. The CFB sheets are the intermediate sheets of the manifold set, each of which is able to have a mark formed on its front surface by a marking pressure and each of which also transmits the contents of ruptured microcapsules from its back surface to the front surface of the next sheet. The CF or recording sheet is the bottom sheet and is only coated on its front surface so that an image may be formed on it.

While it is customary to have the coating containing the microcapsules on the back surface of the sheets and to have the coating containing the reactive component for the capsules on the front surface of each of the sheets, a reverse arrangement is also possible. In addition, one of the reactive ingredients may be carried in the sheets themselves, rather than applied as surface coatings. Furthermore, the reactive component for the colorless dye precursor may be microencapsulated instead of or in addition to the precursor. Patents illustrative of the various kinds of systems that may be used in the production of manifold carbonless copying systems include by way of example: U.S. Pat. Nos. 2,299,694 (Green); 2,712,507 (Green); 3,016,308 (Macaulay); 3,429,827 (Ruus); and 3,720,534 (Macaulay et al.).

The microcapsules used in carbonless systems generally comprise a core of fill material surrounded by a wall or shell of polymeric material. The wall surround the fill material acts to isolate the fill material from the external environment. When it is desirable to release the fill material, e.g., the dye precursor, the capsule wall may be ruptured by mechanical pressure, for example, thereby introducing the fill material into its surroundings. Generally, microcapsules comprise separate and discrete capsules having non-interconnecting hollow spaces. The fill material is thus enveloped within the general continuous polymeric walls of the microcapsules, which may range from 0.1 to approximately 500 microns in diameter.

In carbonless systems it is desirable to obtain a strong image on the recording or CF sheet. One way of enhancing the image of a carbonless system is to increase the concentration of the dye precursor contained in the microcapsules coated on the CB sheet. However, this method of image enhancement suffers from a serious drawback in that dye precursors are generally quite expensive. Therefore, any increase in the concentration of dye precursor in the CB microcapsules necessarily increases the cost of the carbonless copy system. A second solution is to coat more dye containing microcapsules on the transfer or CB sheet. This, however, suffers from the same drawback as the first proposed solution since a greater amount of expensive dye precursor is used in the resulting carbonless system. Thus, there is a need for a carbonless copy system that produces an enhanced image without using an economically prohibitive amount of expensive dye precursor.

Microcapsules that contain only an organic solvent for use in carbonless copy systems are disclosed in U.S. Pat. Nos. 3,663,256 (Miller et al.) and 3,672,935 (Miller et al.). Both of these patents disclose at FIG. 2 (I, Ia, Vb, Vc, and Vd) the use of solvent-only capsules coated on the CB sheet of a manifold system or in a self-contained carbonless system. In each of these schematic diagrams neither of the two reactive mark forming components, i.e., the dye precursor and the clay, is microencapsulated. Thus, the solvent-only microcapsules shown in the Miller et al. patents are the only sources of solvent in these proposed carbonless systems.

The Miller et al. carbonless systems disclosed at FIG. 2 (I, Ia, Vb, Vc, and Vd) have not met with widespread commercial acceptance. Since microencapsulation is the surest means of isolating the mark forming components from each other prior to pressure imaging, the above systems increase the likelihood of inadvertent color develoopment that is a common problem in carbonless copy systems. Premature discoloration has been variously referred to as blush, offset, bluing, ghosting, and backprint. Whatever it is called, it is highly objectionable and undesirable in a carbonless copying system.

The following patent documents disclose various architectures known in the carbonless copying art. U.S. Pat. Nos. Re. 30,041 (Maalouf); Re. 30,116 (Maalouf); 4,003,589 (Konishi et al.); 4,071,469 (Vincent et al.); 4,096,314 (Cespon); 4,130,299 (Wygant); 4,147,830 (Kato et al); 4,187,233 (Petitpierre); 4,211,436 (Kuhlthau et al.); 4,250,098 (Chang); 4,287,074 (Earhart et al.); 4,295,662 (Tutty); 4,309,047 (Petitpierre); 4,316,036 (Petitpierre); 4,343,939 (Cesark et al.); 4,343,944 (Burri); 4,355,823 (Burri); 4,363,503 (Schmidt et al.); and 4,372,581 (Schumacher et al.); and United Kingdom Patient Specifications Nos. 1,290,369 (Fuji); and 1,417,206 (Mizusawa). None of the patents listed above discloses the use of microcapsules that encapsulate a fill material consisting solely of solvent.

SUMMARY OF THE INVENTION

It is an object of the present invention to provide a carbonless copy system having enhanced imaging capability without increased usage of dye precursor.

It is a specific object of the present invention to provide a carbonless copying system including two types of microcapsules. The first type of microcapsule encapsulates either a solution or suspension containing one of the two mark forming components of the carbonless system. Thus, the first type of microcapsule contains either the dye precursor or the reactive clay or resin in solution or suspension. The second type of microcapsule encapsulates only solvent, the solvent being capable of dissolving or suspending either or both of the mark forming components. Thus, the second type of microcapsule does not contain any dye precursor or reactive clay or resin. By contrast, the fill material encapsulated within the second type of microcapsule consists only of solvent, either a single solvent or a mixture of solvents. The two types of microcapsules and the second mark forming component are then arranged in juxaposed pressure-sensitive contact with respect to one another such that when marking pressure is applied to the carbonless system, both types of microcapsules rupture releasing the solvent contained in the second type of microcapsule and the solution or suspension contained in the first type of microcapsule. The first marking component and the second marking component are thus brought into reactive contact and form an image. The presence of the solvent-only microcapsules, however, improves the intensity of the resulting image.

In a preferred carbonless system according to the present invention, the solvent-only microcapsules are coated on the CF along with unencapsulated reactive clay or resin. The CF is then reacted with a conventional CB sheet to form an enhanced image without the need of additional dye precursor. While the solvent-only capsules are desirably coated on the CF or recording sheet, the presence of such capsules in the CB or transfer sheet coating or in both the CF and CB coatings may also result in improved imaging in certain carbonless systems. In addition, the present invention has utility in self-contained carbonless systems.

Further objects and embodiments of the present invention will become evident from the following description of the preferred embodiments and claims.

DESCRIPTION OF THE PREFERRED EMBODIMENTS

In the present invention, microcapsules encapsulating a fill material consisting solely of a solvent that is capable of dissolving either or both of the mark forming components is added to any of a variety of conventional carbonless copying systems. The solvent-only capsules may be incorporated in the CF coating. the CB coating, or both. Additionally, the solvent-only capsules may be used in the context of a self-contained carbonless copy system. Though incorporation of the solvent-only capsules in the CF coating is preferably advantageous with respect to the enhancement of the resulting image, the presence of the solvent only capsules at any point where they are in reactive contact with the two mark forming components may result in image enhancement in certain carbonless systems.

The microcapsules encapsulating only solvent should contain a solvent that is capable of dissolving or suspending either the dye precursor the reactive clay or phenolic resin or both. Suitable solvents include such organic solvents as benzyl butyl phthalate, dibutyl phthalate, toluene, various xylenes, alkyl benzenes, alkyl naphthalenes, diaryl methanes, diaryl ethanes, and alkyl biphenyls or mixtures thereof.

In a preferred embodiment, the fill material to be encapsulated within the first type of microcapsule will usually be a colorless dye precursor such as Crystal Violet Lactone, benzoyl leucomethylene blue, rhodamine lactam, the p-toluene sulfinate of Michler's hydrol, or any of the various chromogenic compounds that are capable of changing from a colorless to a colored form on contact with acidic substances, such as phenolic resins or reactive clays.

The present invention may be used with any of the known classes of microcapsules including polyamide, polyurea, polyurethane, polyester, urea-formaldehyde, melamine-formaldehyde, and gum arabic/gelatin.

Examples 1–9

Nine recording or CF sheets were prepared using resin CF formulations additionally containing various percentages of solvent-only capsules. Each of these nine CF formulations contained 85 parts of Astribrite, a high brightness kaolin coating clay made by Georgia Kaolin, 15 parts of Schenectady HRJ-2162 resin, a zinc chelated para-alkyl substituted novalac phenolic resin manufactured by Schenectady Chemical Company, 10 parts of Starch P.G. 290, produced by Penick and Ford, and 5 parts of Latex Dow 620, an SBR rubber produced by Dow Chemical Company. The CF formulations were coated onto conventional bond at 6.4–7.1 gsm and the sheets of Example 2 only were supercalendered. The solvent encapsulated in the solvent-only microcapsules of Examples 3–5 and 7–9 was KMC 113 oil, which is a blend of diisopropyl naphthalenes produced by Kureha Chemical Co. The CF sheets were then imaged against a black imaging CB suitable for producing images on a phenolic resin based CF. The reflectance values of the resulting images were recorded at three time intervals: (a) immediately after striking the surface of the carbonless system with a typewriter, (b) twenty minutes after impact, and (c) twenty-four hours after the initial strike. The solvent in the solvent-only microcapsules of Example 6 consisted of 50% by weight Santosol 150, a phenyl xylyl methane produced by Monsanto, and 50% be weight of Ucane-12, which is a $C_{10}$–$C_{15}$ linear alkyl substituted benzene produced by Union Carbide. The reflectance measurements were taken on a B & L Opacimeter. The lower the reflectance number, the better or more intense the image. The reflectance values based on percent by weight of solvent-only capsules in the CF coating are shown below for Examples 1–9.

| | Example | | | | | | | | |
|---|---|---|---|---|---|---|---|---|---|
| | 1 | 2 | 3 | 4 | 5 | 6 | 7 | 8 | 9 |
| Percent by weight of solvent-only capsules | 0 | 0 | 1 | 3 | 5 | 5 | 8 | 10 | 15 |

-continued

| | Example | | | | | | | | |
|---|---|---|---|---|---|---|---|---|---|
| | 1 | 2 | 3 | 4 | 5 | 6 | 7 | 8 | 9 |
| Reflectance | | | | | | | | | |
| on impact | 72.9 | 70.3 | 68.1 | 66.4 | 63.3 | 61.8 | 59.0 | 62.4 | 62.0 |
| after 20 min. | 54.7 | 55.9 | 51.7 | 51.6 | 49.3 | 49.3 | 44.0 | 45.2 | 44.0 |
| after 24 hr. | 52.5 | 53.2 | 49.1 | 49.1 | 46.7 | 46.7 | 41.8 | 42.4 | 41.8 |

EXAMPLES 10–18

Additional CF formulations were prepared using varying percentages of solvent-only microcapsules in a manner analogous to Examples 1–9. In Examples 10–18, each of the CF formulations contained 1.75 parts Dispex N-40, a sodium substituted polyacrylate made by Allied Corporation, 60 parts Silton No. 6 clay, which is produced by Mizusawa Company, 40 parts Astribrite, 5 parts Starch P.G. 290, and 15 parts Latex Dow 620. These CF formulations were coated on conventional bond substrates at 6.4–7.1 gsm and the CF sheet of Example 11 was supercalendered. The resulting CF sheets were imaged against several types of black imaging CB's suitable for producing images on an acid-activated clay based CF. The reflectance values were measured on a B & L Opacimeter upon impact, after twenty minutes, and after twenty-four hours. The solvent used in the solvent-only capsules in Examples 12–14 and 16–18 was KMC 113 oil while the solvent used in Example 15 was a 50%—50% by weight mixture of Santosol-150 and Ucane-12. The results for the CF coatings based on percent by weight of solvent-only capsules in the CF coating are shown below.

| | Example | | | | | | | | |
|---|---|---|---|---|---|---|---|---|---|
| | 10 | 11 | 12 | 13 | 14 | 15 | 16 | 17 | 18 |
| Percent by weight of solvent-only capsules | 0 | 0 | 1 | 3 | 5 | 5 | 8 | 10 | 15 |
| CB No. 1 Reflectance | | | | | | | | | |
| on impact | 56.3 | 60.9 | 56.3 | 57.7 | 56.4 | 54.4 | 53.8 | 52.0 | 53.3 |
| 20 min. | 50.5 | 55.1 | 49.8 | 51.4 | 49.4 | 48.6 | 47.6 | 45.9 | 46.3 |
| 24 hr. | 47.8 | 51.9 | 48.2 | 49.8 | 48.3 | 47.4 | 45.7 | 45.3 | 45.6 |
| CB No. 2 Reflectance | | | | | | | | | |
| on impact | 55.2 | 60.0 | 55.0 | 54.9 | 53.7 | 51.4 | 50.7 | 50.1 | 50.4 |
| 20 min. | 48.2 | 52.8 | 46.5 | 46.8 | 45.4 | 43.4 | 42.8 | 41.7 | 41.6 |
| 24 hr. | 43.3 | 47.3 | 43.3 | 43.5 | 42.3 | 40.8 | 39.5 | 39.0 | 39.2 |

EXAMPLES 19–21

In Examples 19–21, 15 parts of Durez 31623 resin, which is a zinc chelated octyl phenol resin produced by Occidental Corporation, was substituted for the 15 parts of Schenectady HRJ-2162 resin in the CF formulations of Examples 1–9. Example 21 used KMC 113 oil as the solvent in the solvent-only microcapsules. The resulting CF formulations were coated on ordinary bond paper and the CF sheet of Example 20 was supercalendered. The reflectance values for the resulting CF sheets when imaged against the three component black CB are shown below:

| | Example | | |
|---|---|---|---|
| | 19 | 20 | 21 |
| Percent by weight solvent-only capsules | 0 | 0 | 5 |
| Reflectance | | | |
| on impact | 63.8 | 66.7 | 60.3 |

-continued

| | Example | | |
|---|---|---|---|
| | 19 | 20 | 21 |
| 20 min. | 54.6 | 56.2 | 45.0 |
| 24 hr. | 53.3 | 54.8 | 43.7 |

As can be seen from Example 3, the addition of as little as one percent by weight of solvent-only capsules to a conventional CF formulation results in a significant increase in the intensity of the resulting image. The image enhancement continues to increase with the addition of higher percentage of solvent-only capsules with maximum image enhancement occurring somewhere between eight and ten percent by weight. Thus, the use of solvent-only capsules in a conventional CF formulation increases the image formed by the carbonless copy system without the necesity of increasing the use of expensive dye precursor. This results in a more desirable carbonless copy system and avoids the need to increase the use of costly precursors.

EXAMPLES 22–31

In the following examples, solvent-only microcapsules were added to a conventional black imaging CB formulation for carbonless copy systems. The solvent used in the dye precursor microcapsules was a blend of KMC 113 and Ucane 12. The solvent used in the solvent-only microcapsules consisted of a similar blend. The dye precursor microcapsules and the solvent-only microcapsules were coated at 2.8 gsm on conventional bond paper. Examples 22–26 used microcapsules containing a solution of chromogens that produced a suitable black image on phenolic resin based CF's. Examples 27–31 used microcapsules containing a solution of chromogens that produced a suitable black image on acid-activated clay based CF's. The various CB formulations were then imaged against appropriate CF's and the reflectance values again recorded on a B & L Opacimeter immediately upon impact, after 20 minutes and after 24 hours. THe results, based on the percentage of solvent-only microcapsules by weight in the CB coating, are shown below, including comparisons to similar image producing CB coatings having no solvent-only capsules with coating weights equivalent to the dye precursor microcapsule content in the coatings containing solvent-only capsules:

| | Example | | | | | | | | | |
|---|---|---|---|---|---|---|---|---|---|---|
| | 22 | | 23 | | 24 | | 25 | | 26 | |
| Percent by weight of solvent-only capsules | 0% | * | 10% | * | 20% | * | 30% | * | 40% | * |
| Coating weight of CB coatings (gsm) | 2.80 | 2.80 | 2.80 | 2.52 | 2.80 | 2.24 | 2.80 | 1.96 | 2.80 | 1.68 |
| Reflectance | | | | | | | | | | |
| On Impact | 58.4 | 58.4 | 58.2 | 59.6 | 59.0 | 60.9 | 59.1 | 62.1 | 61.3 | 63.3 |
| After 20 min. | 38.3 | 38.3 | 38.4 | 40.7 | 40.6 | 43.0 | 42.1 | 45.4 | 45.6 | 47.8 |
| After 24 hrs. | 35.4 | 35.4 | 36.4 | 37.5 | 38.3 | 39.6 | 40.1 | 41.7 | 44.1 | 43.8 |

| | Example | | | | | | | | | |
|---|---|---|---|---|---|---|---|---|---|---|
| | 27 | | 28 | | 29 | | 30 | | 31 | |
| Percent by weight of solvent-only capsules | 0% | * | 10% | * | 20% | * | 30% | * | 40% | * |
| Coating weight of CB coatings | 2.80 | 2.80 | 2.80 | 2.52 | 2.80 | 2.24 | 2.80 | 1.96 | 2.80 | 1.68 |
| Reflectance | | | | | | | | | | |
| On Impact | 44.0 | 44.0 | 44.4 | 46.3 | 46.7 | 48.6 | 48.2 | 50.9 | 54.2 | 53.2 |
| After 20 Min. | 38.7 | 38.7 | 39.6 | 41.0 | 41.1 | 43.4 | 42.4 | 45.7 | 49.5 | 48.1 |
| After 24 hrs. | 35.7 | 35.7 | 35.2 | 37.4 | 38.2 | 39.1 | 39.2 | 40.8 | 44.5 | 42.5 |

*Same dye precursor capsule content, but no solvent-only capsules.

As can be seen from the results in Examples 22–31, the addition of solvent-only microcapsules to the CB coatings for carbonless systems generally results in increased image intensity compared to similar CB coating containing no solvent-only capsules. Theoretically, a wide latitude exists for incorporating large amounts of solvent-only capsules to the CB coating. However, at the higher percentages, intensity of the image compared to the starting intensity deteriorates markedly due to dilution. For a given CB coating weight the optimum proportion of solvent-only microcapsules will be reached when the image intensity of the blend coating equals the image intensity of a coating identical in weight but with no solvent-only capsules present. In the case of the above examples, this occurs when the level of solvent-only capsules is equivalent to 10–20% of the coating weight of the system.

The use of solvent-only capsules in a conventional CB formulation increases the image formed by the system without the necessity of increasing the use of expensive dye precursor. This results in a more desirable carbonless copy system and avoids the need to increase the use of costly precursors. It is believed by applicant that the salutary results of the present invention are due to the solvent in the solvent-only capsules aiding the penetration of the dye precursor into the reactive CF coating, whether clay or resin. However, applicant's invention is not to be limited by this hypothesis of the mechanism behind the advantageous results of the present invention. In addition, it is to be understood that the above specification emphasizes certain embodiments and features of the present invention and that many other embodiments not specifically described may come within the spirit and scope of the present invention as hereafter claimed.

I hereby claim as my invention:

1. In a carbonless copying system having a recording substrate, first and second mark-forming components capable of reacting with each other to produce a colored reaction product, and microcapsules having generally continuous walls encapsulating a first fill material, the first fill material comprising a solution or suspension containing the first mark-forming component, the improvement in combination therewith comprising, microcapsules having generally continuous walls encapsulating a second fill material, the second fill material consisting of solvent capable of dissolving either the first or the second mark-forming component or both, the microcapsules encapsulating the first fill material, the microcapsules encapsulating the second fill material, and the second mark-forming component being arranged in juxtaposed pressure-sensitive contact with respect to one another such that the application of marking pressure upon the carbonless system causes a colored marked to form on the recording substrate.

2. The carbonless copying system of claim 1 wherein the first mark-forming component is a colorless dye precursor and the second mark-forming component is an acidic clay or phenolic resin.

3. The carbonless copying system of claim 2 wherein the second fill material is an organic solvent capable of dissolving the colorless dye precursor.

4. The carbonless copying system of claim 3 wherein the microcapsules encapsulating the second fill material and the second mark-forming component are coated over at least a portion of the recording substrate.

5. The carbonless copying system of claim 4 additionally comprising a transfer substrate wherein the microcapsules encapsulating the first fill material are coated over at least a portion of the transfer substrate.

6. The carbonless copying system of claim 3 additionally comprising a transfer substrate wherein the microcapsules encapsulating the second fill material and the microcapsules encapsulating the first fill material are both coated over at least a portion of the transfer substrate.

* * * * *

REEXAMINATION CERTIFICATE (906th)

United States Patent [19] [11] B1 4,636,818

Jerabek [45] Certificate Issued Aug. 2, 1988

[54] CARBONLESS SYSTEM INCLUDING SOLVENT-ONLY MICROCAPSULES

[75] Inventor: Richard J. Jerabek, Grand Island, N.Y.

[73] Assignee: Moore Business Forms, Inc., Grand Island, N.Y.

Reexamination Request:
No. 90/001,268, Jun. 26, 1987

Reexamination Certificate for:

| | |
|---|---|
| Patent No.: | **4,636,818** |
| Issued: | **Jan. 13, 1987** |
| Appl. No.: | **742,113** |
| Filed: | **Jun. 5, 1985** |

[51] Int. Cl.[4] ..... B41M 5/16; B41M 5/22

[52] U.S. Cl. ..... 503/213; 427/150; 427/151; 503/206; 503/215

[58] Field of Search ..... 427/150, 151; 503/204, 503/206, 213, 215, 226

[56] References Cited

U.S. PATENT DOCUMENTS 3,617,334 11/1971 Brockett et al. ..... 503/207
4,596,996 6/1986 Sandberg et al. ..... 503/207

*Primary Examiner*—Bruce H. Hess

[57] ABSTRACT

A carbonless system having improved imaging characteristics by the use of microcapsules containing only solvent is disclosed. The solvent-only capsules are disposed within a carbonless system to enhance the resulting image without the use of additional dye precursor.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-6 are cancelled.

* * * * *